US005279469A

United States Patent [19]

Foit

[11] Patent Number: 5,279,469

[45] Date of Patent: Jan. 18, 1994

[54] CABLE WINDING APPARATUS AND METHOD

[75] Inventor: Vilem Foit, Vancouver, Canada

[73] Assignee: Hillmar Industries Ltd., Delta, Canada

[21] Appl. No.: 811,231

[22] Filed: Dec. 20, 1991

[51] Int. Cl.[5] ..... B65H 75/18

[52] U.S. Cl. ..... 242/54 R; 254/278

[58] Field of Search ..... 242/54 R, 117, 118, 118.4, 118.6, 77, 77.1, 77.3, 77.4, 86.61, 158.1, 158.5, 118.41; 254/278

[56] References Cited

U.S. PATENT DOCUMENTS

| | | | |
|---|---|---|---|
| 1,414,679 | 5/1922 | Turney | 242/1 |
| 3,135,478 | 6/1964 | Harlander | 242/117 |
| 3,576,295 | 4/1971 | Hale | 242/54 R |
| 3,670,988 | 6/1972 | Leonard | 242/117 X |
| 3,717,313 | 2/1973 | Williams | 242/54 R |
| 3,809,334 | 5/1974 | Beurer et al. | 242/54 R X |
| 3,837,590 | 9/1974 | Pollak | 242/117 X |
| 3,877,660 | 4/1975 | Bernard | 242/54 R X |
| 3,941,324 | 3/1976 | Green | 242/54 R |
| 3,946,618 | 3/1976 | Green | 242/117 |
| 3,960,340 | 6/1976 | Naas | 242/117 |
| 3,982,402 | 9/1976 | Lang et al. | 242/54 R X |
| 4,226,378 | 10/1980 | Fitzgerald et al. | 242/54 R X |
| 4,410,297 | 10/1983 | Lynch | 242/54 R X |
| 4,447,013 | 5/1984 | Sandered et al. | 242/54 R |
| 4,465,253 | 8/1984 | Lang et al. | 242/54 R X |
| 4,830,300 | 5/1989 | Taylor et al. | 242/54 R |

FOREIGN PATENT DOCUMENTS

| | | | |
|---|---|---|---|
| 61-229780 | 10/1986 | Japan | 242/54 R |
| 2210355 | 6/1989 | United Kingdom | 242/54 R |

*Primary Examiner*—Daniel P. Stodola
*Assistant Examiner*—John P. Darling
*Attorney, Agent, or Firm*—Brian M. Long

[57] ABSTRACT

A cable winding mechanism and method employ a cable reel having a hub portion having an axis of rotation and first, second and third sets of spokes extending radially outwardly from the hub portion, with the second spoke set located between the first and third spoke sets and defining therewith first and second winding gaps, respectively, for accommodating respective monospiral windings of a cable. A drive rotates the cable reel about the axis of rotation of the hub portion and a cable deflector guides cable into the first and second winding gaps during the winding of the cable on the reel. The second set of spokes is interrupted by a cross-over gap at which the cable can extend between the first and second winding gaps and the cable deflector is displaced, in timed relation to the rotation of the reel, so as to guide the cable alternately into the first and second winding gaps and through the cross-over gap. The diameter of the reel is thus substantially less than that of a single monospiral reel for the same cable length.

7 Claims, 4 Drawing Sheets

CABLE WINDING APPARATUS AND METHOD

BACKGROUND OF THE INVENTION

1. Field of the Invention

The present invention relates to a cable winding apparatus and method and is useful in particular, but not exclusively, for winding the power cables of electrically driven mobile cranes.

2. Description of Related Art

A typical power cable which is required to be wound on a reel on a mobile crane may have a diameter of 2½ inches and a length of 3000 ft. If such a cable is wound on a monospiral reel, because of the above dimensions of the cable, the monospiral reel requires a diameter of 30 ft.

Such a large reel involves an undesirably high capital cost and is vulnerable to damage. Also, it is difficult to install and subjects the cable to undesirable high tensions and wear and, moreover, is heavy and presents a large wind exposure area. A further disadvantage of a cable reel of this size is that it has a high inertia and, consequently, can easily exert an unacceptably high tension on the cable.

The alternative of a level wind drum has the disadvantages that the cable is not ventilated at all sides and may therefore be derated; that the cable is unduly tension; and that a large floor area is required to accommodate the level wind reel.

SUMMARY OF THE INVENTION

It is accordingly an object of the present invention to provide a novel and improved power cable winding mechanism which enables a power cable to be wound on a reel in two or more separate monospiral windings.

It is a further object of the present invention to provide a method of winding a power cable which uses two or more separate cable monospiral windings to substantially reduce the cable winding diameter as compared with a single monospiral winding of the same length of cable.

According to the present invention, there is provided a cable winding mechanism employing a cable reel having a hub portion, with an axis of rotation, and first, second and third sets of spokes extending radially outwardly from the hub portion. The second spoke set is located between the first and third spoke sets and defines therewith first and second winding gaps for accommodating respective monospiral windings of a cable.

The cable reel is rotated about the axis of rotation of the hub portion while the cable is guided by a cable deflector into the first and second gaps.

The second set of spokes is interrupted by a cross-over gap at which the cable can extend between the first and second winding gaps. The cable deflector is displaced, in timed relation to the rotation of the reel, so as to guide the cable alternately into the first and second winding gaps and through the cross-over gap.

Preferably, pairs of turns of the cable are formed alternately in the first winding gap and the second winding gap, with the cable extending through the cross-over gap after each pair of turns in order to ensure that a build-up does not occur at the cross-over gap and to produce a smooth cross-over and a good reel balance.

Since the cable is wound in separate monospiral windings in the first and second winding gaps, the diameter of the reel is correspondingly reduced as compared with the type of reel which would be required for a single monospiral winding of the same cable length.

Thus, the present mechanism is particularly useful for power cables of mobile cranes having long runway lengths, since it enables the use of relatively small diameter cable reels on the cranes.

BRIEF DESCRIPTION OF THE DRAWINGS

Further objects, features and advantages of the present invention will become more readily apparent to those skilled in the art from the following description of the invention when taken in conjunction with the accompanying drawings, in which.

DESCRIPTION OF THE PREFERRED EMBODIMENT

Figure 1:
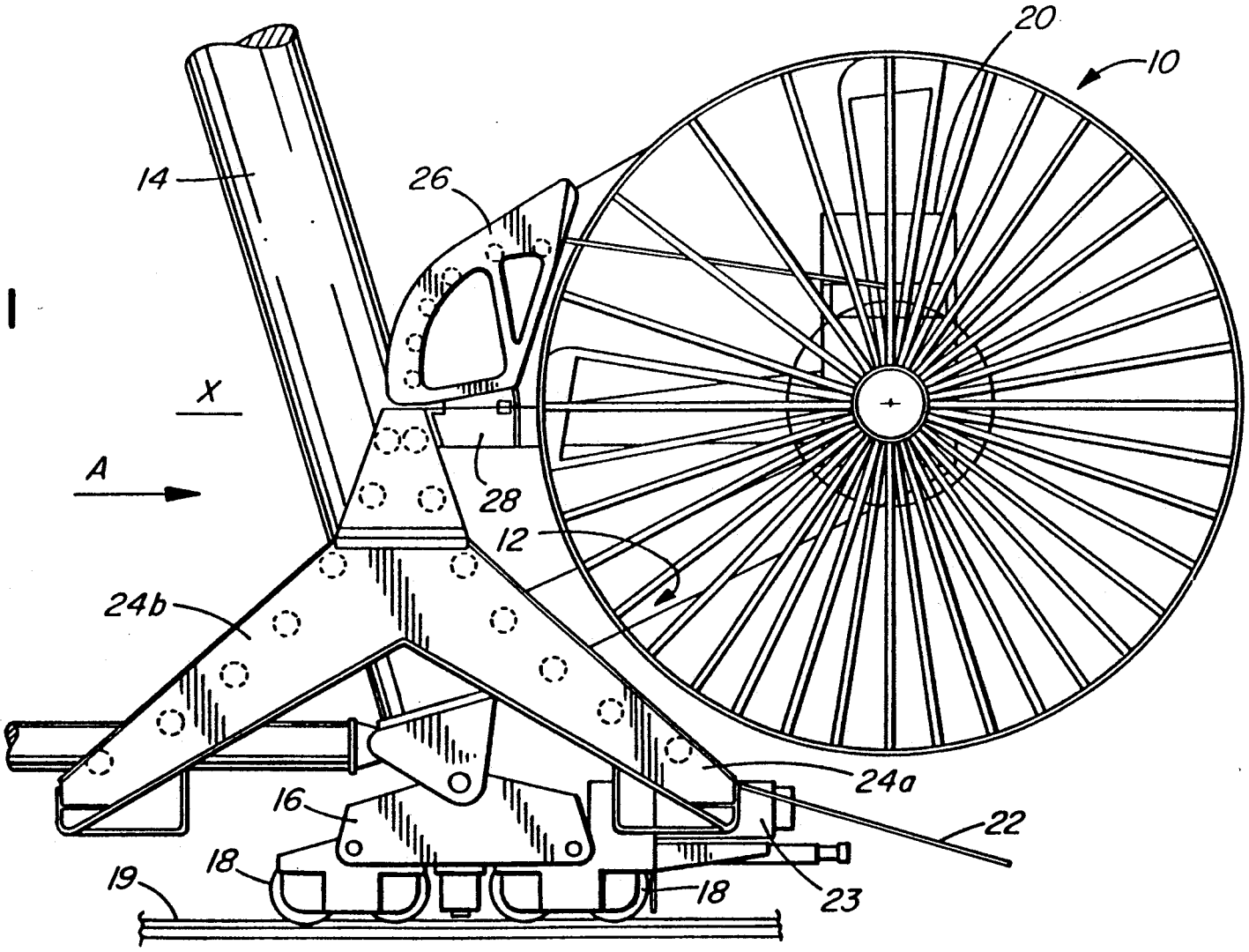
FIG. 1 shows a view in side elevation of a reel winding mechanism according to the present invention installed on a crane, of which only a portion is shown.
Figure 2:
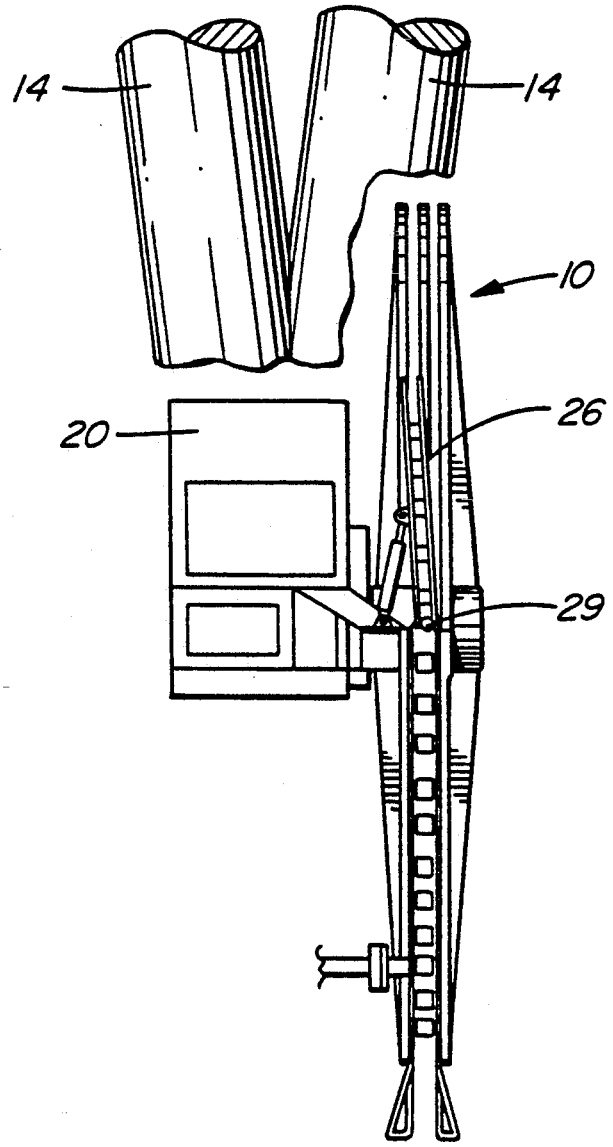
FIG. 2 shows a view in end elevation of the reel winding mechanism of FIG. 1, taken in the direction of arrow A of FIG. 1.

As shown in FIGS. 1 and 2 of the accompanying drawings, a cable reel indicated generally by reference numeral 10 is mounted on a platform 12 forming part of a mobile crane, of which only a portion is shown in the drawings.

More particularly, the platform 12 projects from a pair of upwardly divergent arms 14, which are carried on a chassis 16 supported on wheels 18 running on a pair of rails 19, of which only one is illustrated.

The platform 12 also carries a drive motor 20 which serves to rotate the reel 10 for winding a power cable 22 on the reel 10. The power cable 22 supplies electrical power to the drive motor 20 for driving the reel 10 and also to other electrical motors, such as a motor 23 on the chassis 16, for driving the crane along the rails 19.

The power cable 22 is guided towards the reel 10 by a cable diverter 24 which, as can be seen from FIG. 1, has an inverted "Y" shape, with two downwardly divergently inclined arms **24*a* and 24*b*. The two arms 24*a* and 24*b* are provided for guiding the cable 22 at opposite sides of a location at which a fixed end of the cable enters the ground. As illustrated in FIG. 1, the arm 24*a* is guiding the cable 22**.

Figure 3:
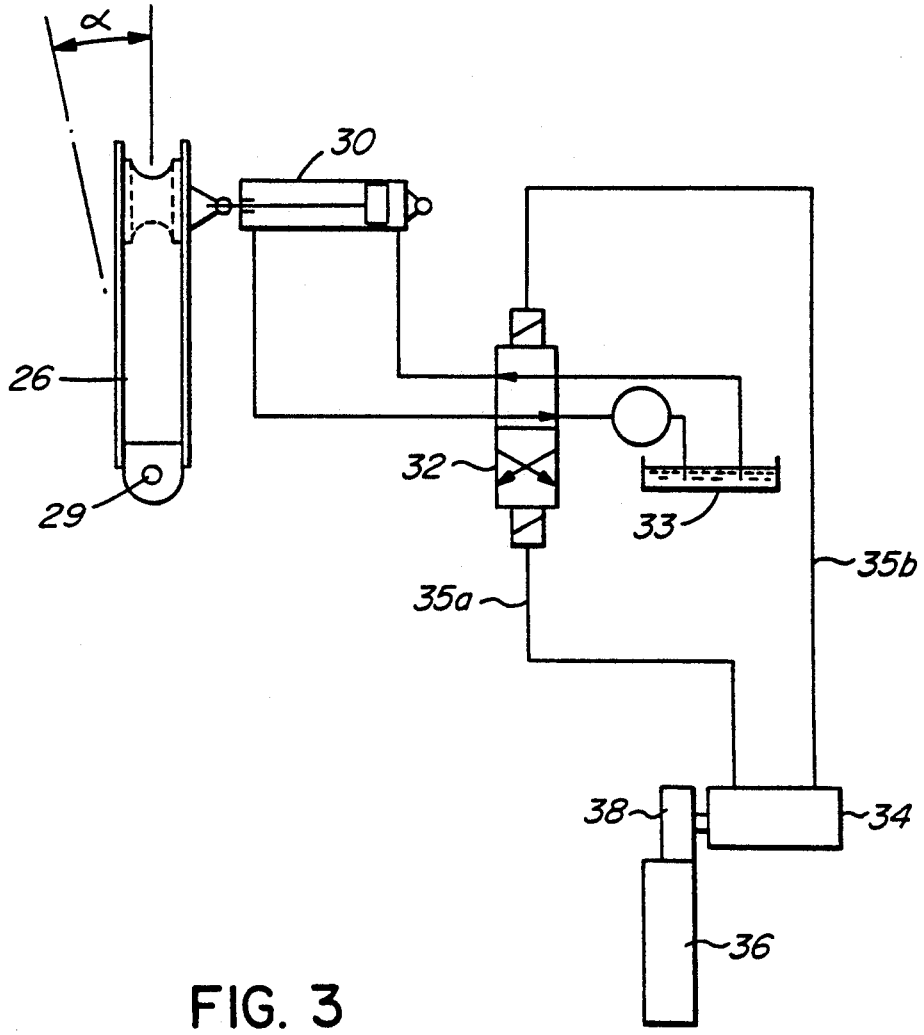
FIG. 3 shows a diagram of a cable deflector and control system forming part of the mechanism of FIG. 1.
Figure 3A:
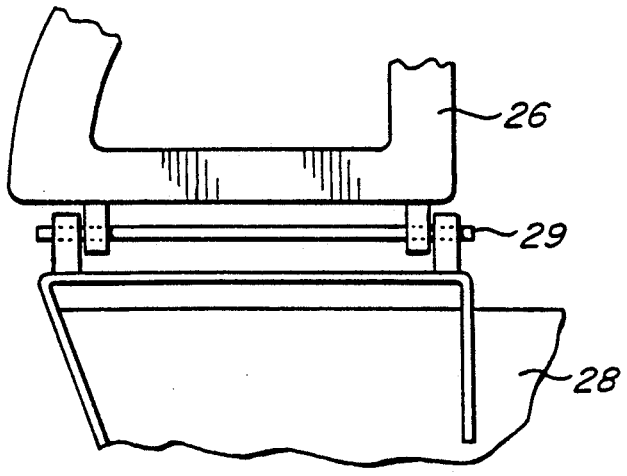
FIG. 3A shows a broken-away view, in side elevation, of a part of the mechanism of FIG. 1.

From the cable diverter 24, the cable 22 is guided over a cable indexing device or deflector 26 to the reel 10. The cable deflector 26 is mounted on a support frame 28 and is pivotable to and fro relative to the support frame 28 through an angle α (FIG. 3) about a shaft 29 (FIGS. 3 and 3A) having a horizontal axis X (FIG. 1) for correspondingly varying the location at which the cable 22 is wound on the reel 10, as described in greater detail below.

This pivotation of the cable deflector 26 is effected by a hydraulic piston and cylinder device 30 (FIG. 3), and an electrically operated hydraulic valve 32 controls the flow of hydraulic actuating fluid to and from the hydraulic piston and cylinder device 30.

The operation of the hydraulic valve 32 is, in turn, controlled by a rotary cam switch 34, connected to the hydraulic valve 32 by electrical conductors 35*a* and 35*b*. The rotary cam switch 34 is driven from a slew bearing 36 on the reel 10 through a pinion 38 connected to the rotary cam switch 36.

Figure 4:
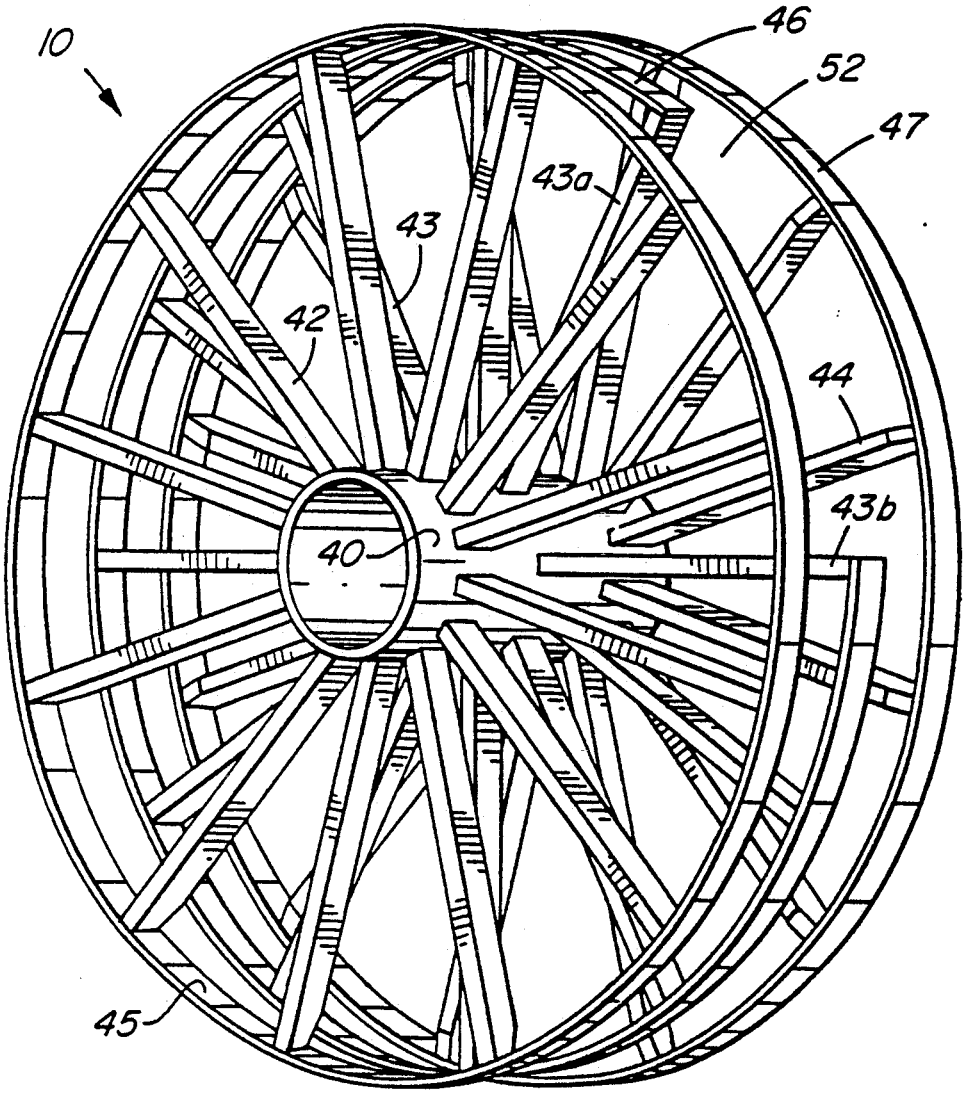
FIG. 4 shows a view in perspective of a cable reel forming part of the mechanism of FIG. 1.

The reel 10, as can most readily be seen from FIG. 4, has a hub portion 40 and three sets of spokes, namely a first set of spokes 42, a second set of spokes 43 and a third set of spokes 44, extending radially outwardly of the hub portion to respective rims 45, 46 and 47. The spokes 43 of the second set are located midway between and spaced from those of the first and second sets in the axial direction of the hub portion 40.

Figure 5:
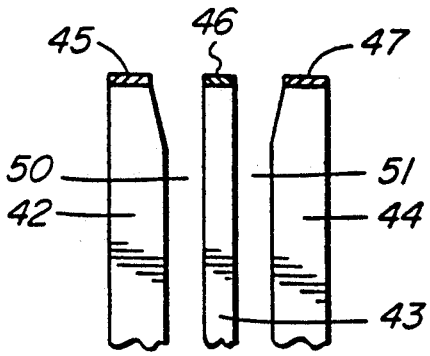
FIG. 5 shows a broken-away portion of the reel of FIG. 4.

As shown in FIG. 5, the first and second spoke sets define therebetween a first winding gap 50 for accommodating a monospiral winding of the cable 22, as described below, and the second and third spoke sets define therebetween a second winding gap 51 for accommodating another monospiral winding of the cable 22.

The widths, parallel to the axis of the hub portion 40, of the winding gaps 50 and 51 are just slightly greater than the diameter of the cable 22, and are therefore sufficiently narrow to prevent laterally adjacent windings of the cable 22 in either of the winding gaps 50 and 51. The the cable 22 is received snugly in the winding gaps 50 and 51, without the successive turns of the cable 22 being laterally offset from one another, which would cause the cable 22 to exert undesirable lateral forces on the spokes of the reel 10.

Referring again to FIG. 4, it can be seen that the rim 46 of the second set of spokes 43 is interrupted to form between two of the spokes, which are identified by reference numerals 43*a* and 43*b*, a gap indicated by reference numeral 52.

This gap 52 serves as a cross-over gap through which the cable 22 can pass between the first and second winding gaps 50 and 51.

When the drive motor 20 is energised to rotate the reel 10 for the purpose of winding the cable 22 onto the reel 10, the rotation of the reel 10 is transmitted through the slew bearing 36 and the pinion 38 to actuate the rotary switch.

The rotary switch is such that, for each two rotations of the reel 10, the polarity of the rotary switch 8 is reversed, and thus the cable deflector 26 is pivoted through the angle $\alpha$. This angle is selected so as to deflect the cable 22 from one to the other of the winding gaps 50 and 51, as the cable deflector 26 is swung through this angle. Also, the swinging of the cable deflector 26 is timed so that, when this swinging takes place, the cable 22 is deflected through the cross-over gap 52. Since the cable deflector 26 is swung through the angle $\alpha$ once during each two rotations of the reel 10, two monospiral turns of the cable are laid in one of the winding gaps during the first two reel rotations, then another two monospiral turns of the cable 22 are laid in the other winding gap, and so on. Thus, pairs of turns of the cable are formed alternately in the winding gaps, with the cable extending through the cross-over gap between successive ones of these so that portions of the cable are superimposed upon one another in the cross-over gap 52. In this way, build up of the cable in the cross-over gap 52 is avoided.

When the cable 22 has been fully wound onto the reel 10, the cable forms two laterally spaced monospiral windings which are separated from one another by the second set of spokes 43.

It will be apparent that the diameter of these two windings, and thus the diameter of the reel 10, are substantially less than would be the case for a single monospiral winding of the same length of cable.

Consequently, the reel 10 and associated components of the winding mechanism may be of lighter and less expensive structure than would otherwise be required. This has the further advantage that the inertia of the reel 10, and consequently the tensions caused by the reel 10 in the cable 22, are less, so that the risk of damage to the cable 22 is reduced.

Since the cable is wound in monospiral windings between the spokes, cooling of the cable 22 by ambient air is promoted, thus avoiding derating of the cable. Also, since the cable 22 needs to be lifted to a substantially lower height as compared to what is required for a single monospiral reel, the consequential cable tensions are reduced. In addition, the reel 10 has a relatively low weight and wind exposure area.

As will be apparent to those skilled in the art, various modifications of the present invention may be made within the scope of the invention as defined in the appended claims. For example, the invention is not restricted to the use of only two monospiral windings, but by increasing the number of winding gaps between the spoke sets to three or more, with an appropriate number of cross-over gaps, a correspondingly larger number of windings may be used.

I claim:

1. A cable winding mechanism, comprising:

a cable reel;

said cable reel comprising a hub portion having an axis of rotation and first, second and third sets of spokes extending radially outwardly from said hub portion;

said second spoke set being located between said first and third spoke sets and defining therewith first and second winding gaps, respectively, for accommodating windings of a cable;

said first and second winding gaps being monospiral winding gaps each having a width, parallel to said axis of rotation, sufficiently narrow to prevent laterally adjacent windings of the cable in either of said first and second winding gaps;

means for rotating said cable reel about the axis of rotation of said hub portion;

a cable deflector for guiding the cable into said first and second monospiral winding gaps during the winding of the cable on said reel;

said second set of spokes being interrupted by a cross-over gap at which the cable can extend between said first and second monospiral winding gaps;

said cross-over gap extending radially outwardly, and being free of obstruction, from said hub to the periphery of said reel so as to allow a plurality of turns of the cable to be superimposed on one another in said cross-over gap; and means for displacing said cable deflector, in timed relation to the rotation of said reel, so as to guide the cable alternately into said first and second monospiral winding gaps and through said cross-over gap.

2. A cable winding mechanism as claimed in claim 1, wherein said displacing means comprise means for causing pairs of turns of the cable to be formed alternately in said first monospiral winding gap and said second monospiral winding gap.

3. A cable winding mechanism as claimed in claim 1, further comprising means supporting said cable deflector for pivotation to and fro to guide the cable into said first and second monospiral winding gaps and into said cross-over gap.

4. A cable winding mechanism as claimed in claim 3, wherein said displacing means comprise a rotary cam switch, means for driving said rotary cam switch in timed relation to the rotation of said reel, hydraulic cylinder means for effecting the pivotation of said cable deflector to and fro and valve means actuated by said rotary cam means for controlling said hydraulic cylinder means.

5. A cable winding mechanism as claimed in claim 1, wherein said displacing means comprise a rotary cam switch, means for driving said rotary cam switch in timed relation to the rotation of said reel, hydraulic cylinder means for moving said cable deflector to and fro and valve means actuated by said rotary cam means for controlling said hydraulic cylinder means.

6. A method of winding a cable onto a reel having first and second monospiral winding gaps for receiving said cable and a cross-over gap through which said cable can extend between said monospiral winding gaps, the method comprising the steps of:

rotating said reel about an axis of rotation thereof;

guiding said cable into said first and second monospiral winding gaps during the rotation of said reel so as to form first and second monospiral windings of said cable in said first and second winding gaps, respectively; and controlling the guiding of said cable in timed relation to the rotation of said reel so as to deflect said cable repeatedly through said cross-over gap during rotation of said reel and thereby to deposit the cable turns in said first and second monospiral winding gaps with portions of said cable superimposed on one another in said cross-over gap between the first and second monospiral windings.

7. A method as claimed in claim 6, in which the guiding of said cable includes forming pairs of turns of said cable alternately in said first and second monospiral winding gaps, with said cable extending through said cross-over gap between successive ones of said pairs.

* * * * *